US010266386B1

(12) United States Patent
Gallagher

(10) Patent No.: US 10,266,386 B1
(45) **Date of Patent: *Apr. 23, 2019**

(54) EASY CLEAN WATER BOTTLE DISPENSER

(71) Applicant: Kenneth John Gallagher, Las Vegas, NV (US)

(72) Inventor: Kenneth John Gallagher, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/147,628

(22) Filed: Sep. 29, 2018

Related U.S. Application Data

(60) Provisional application No. 62/679,942, filed on Jun. 3, 2018.

(51) Int. Cl.
*B67D 3/00* (2006.01)

(52) U.S. Cl.
CPC ..... *B67D 3/0035* (2013.01); *B67D 3/0061* (2013.01); *B67D 3/0083* (2013.01)

(58) Field of Classification Search
CPC .. B67D 3/0029; B67D 3/0032; B67D 3/0035; B67D 3/0054; B67D 3/008; B67D 3/0083; B67D 3/0087; B67D 3/0061
See application file for complete search history.

(56) References Cited

U.S. PATENT DOCUMENTS 868,439 A * 10/1907 Hyed ..... B67D 3/0029 222/131
882,552 A * 3/1908 Cordley ..... B67D 3/00 165/154
1,009,437 A * 11/1911 Patnaude ..... B65D 53/02 165/154
1,142,210 A * 6/1915 Wagner ..... B67D 3/0035 141/330
1,501,068 A * 7/1924 Schatz ..... F25D 3/08 222/129
1,574,495 A 2/1926 Look
1,591,623 A * 7/1926 Hassensall ..... B67D 3/00 222/146.6
1,658,227 A * 2/1928 Allen, Jr. ..... B67D 3/0029 141/285
1,881,929 A * 10/1932 Pottenger, Jr. ..... B65D 53/02 137/855
1,960,604 A * 5/1934 Van Fleet ..... B67D 3/00 62/171
2,056,863 A 10/1936 Napier
3,974,863 A 8/1976 Frahm
4,972,976 A 11/1990 Romero
(Continued)

*Primary Examiner* — Patrick M. Buechner

(57) ABSTRACT

A dispenser for delivering a liquid from an inverted supply bottle. The dispenser has a base. A top portion of the dispenser base is where the inverted supply bottle is supported. A side opening is formed in a sidewall of the dispenser base. A foot is formed at a bottom portion of the dispenser base. A reservoir container rests upon dispenser base. The reservoir container is detached from the inverted supply bottle. A bottle collar engages a top portion of the dispenser base. The bottle collar is adapted to engage the inverted supply bottle. The bottle collar has a center aperture in a bottle seat where a mouth of the inverted supply bottle extends through. The liquid from the inverted supply bottle is delivered from the mouth of the inverted supply bottle into the reservoir container and through the side opening in the dispenser base.

5 Claims, 13 Drawing Sheets

(56) References Cited

U.S. PATENT DOCUMENTS

| | | | | |
|---|---|---|---|---|
| 5,431,205 | A | 7/1995 | Gebhard | |
| 5,509,583 | A | 4/1996 | Dolson | |
| 6,557,735 | B1 * | 5/2003 | Stray | B67D 3/0029 222/185.1 |
| 9,580,292 | B2 | 2/2017 | Smith | |
| 9,932,219 | B1 * | 4/2018 | Gallagher | B67D 3/0035 |
| 2010/0314416 | A1 | 12/2010 | Wezner | |
| 2013/0341355 | A1 | 12/2013 | Weaver | |
| 2018/0064064 | A1 * | 3/2018 | Sayag | B67D 3/0035 |

* cited by examiner

FIG. 5
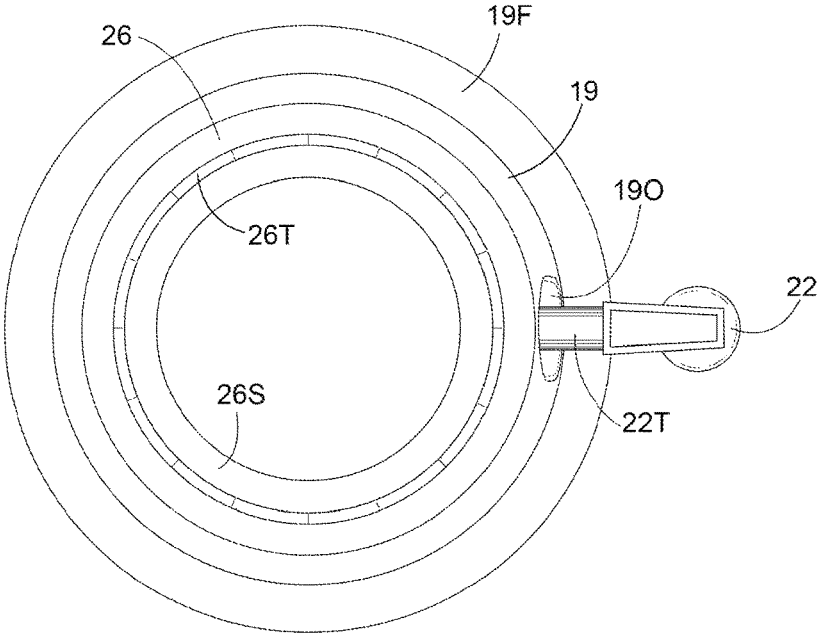
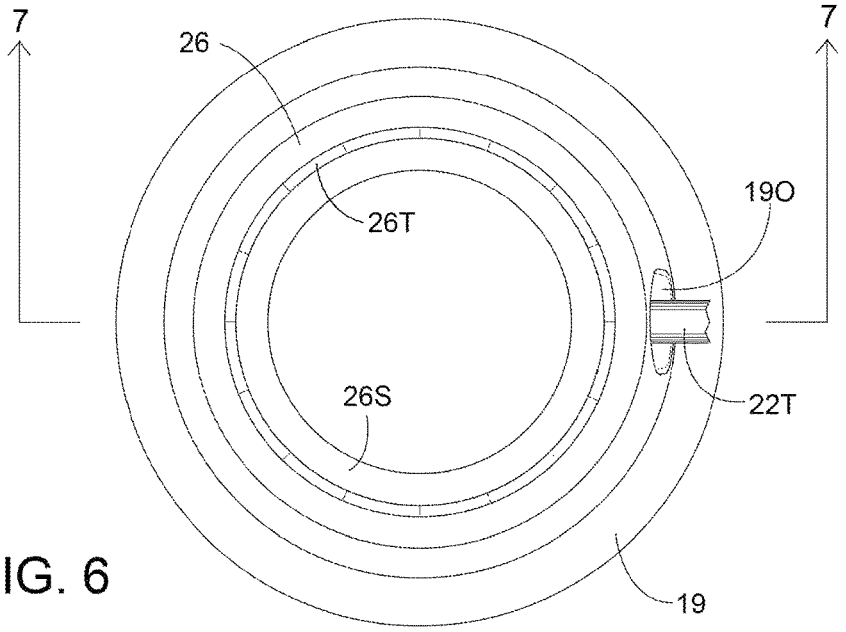
FIG. 6

FIG. 13
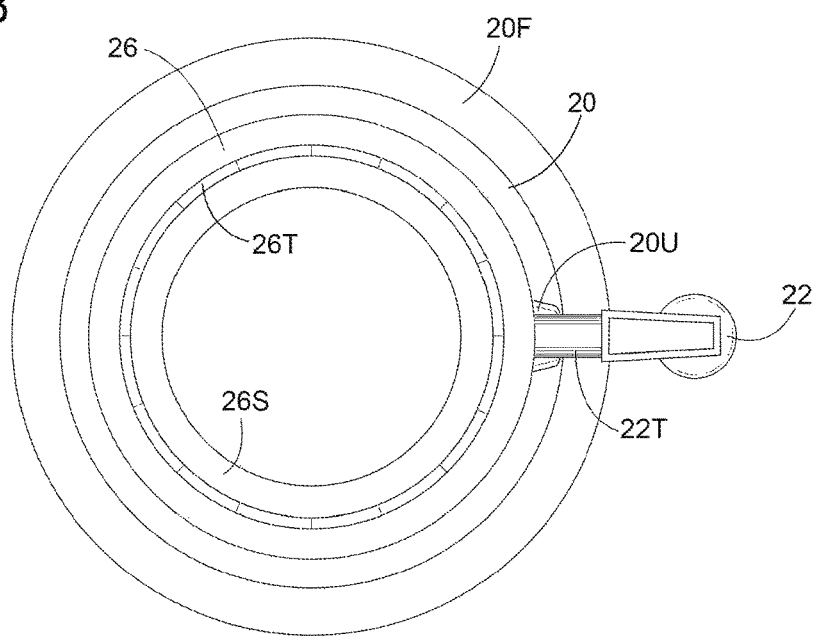
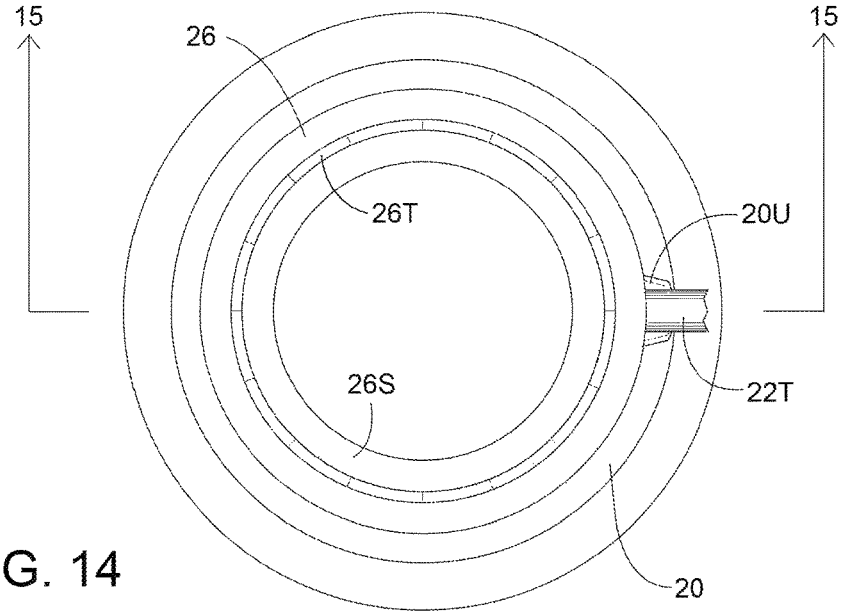
FIG. 14

EASY CLEAN WATER BOTTLE DISPENSER

CROSS REFERENCE TO RELATED APPLICATIONS

The present application claims the benefit of U.S. Provisional Application No. 62/679,942 filed on 2018 Jun. 3, entitled "EASY CLEAN WATER BOTTLE DISPENSER" in the name of Kenneth J. Gallagher, and which is incorporated herein by reference in its entirety.

BACKGROUND OF THE DISCLOSURE

The present application generally relates to an inverted bottle water dispenser, and more particularly, to water bottle dispensers that provide a convenient and simplified mechanism to access bottled water in a direct manner. With the advent of increased popularity of bottled spring water and bottled purified water here and abroad, a need may have developed for water bottle dispensers that may provide a convenient and simplified mechanism to access bottled water. Presently, water may be dispensed through a variety of dispensers. One of the most common types of water dispensers is an inverted water bottle dispenser. Currently, most of the inverted water bottle dispensers on the market are designed for use with large reusable water bottles that range in size from 3 to 5 gallons or more. Water bottle dispensers for water bottles in the size range of 3 liters to 2 gallons are not widely used, and there are only a few water bottle dispensers that are designed to use single use water bottles in the 3 liter to 1.5 gallons size. Moreover, the 3 to 5 gallons dispensers may present a number of practical placement and use restrictions and problems. Consequently, there is a need for a countertop and desktop dispenser that may accommodate 3 liter to 1.5 gallon size bottles. However, the current inverted water bottle dispensers on the market may have a reservoir container that can grow algae quickly, and the process of cleaning the algae from the reservoir containers and valves of the current dispensers on the market can be quite burdensome, as the dismantling of these dispensers for cleaning can be quite difficult and time consuming. Subsequently, there is a need for an inverted water bottle dispenser wherein the reservoir container and the valve can be easily accessed and cleaned.

Over the years, a number of U.S. patents have issued on dispensing valves/valve parts, and water dispensing devices. U.S. Pat. No. 4,293,082 issued to Shinji Matsueda shows one way in which an inverted bottle can be supported by a stand that includes a thermal insulator for the inverted bottle. U.S. Pat. No. 5,123,720 issued to Blomster et al. discloses a floor based inverted water bottle stand for a 5 gallons bottle. As with the Shinji patent, the Bolomster et al. is patenting the stand that supports an inverted bottle. U.S. Pat. No. 5,647,416 issued to Desrosiers et al. discloses another patent on a stand for a 5 gallons bottle that includes a reservoir and the support housing for the reservoir.

U.S. Pat. No. 6,241,126 issued to Andrew Goodman discloses a personal beverage desktop dispenser with a cubical base and valve housed therein. The male bottle threads are mated with the female threads of the base. An issue with this embodiment is that it may be difficult to invert the entire dispenser to union it with the upright bottle since the bottle valve is secured to the base. Even if the valve was not secured to the base, the valve with the handle is too large to fit through the bottle hole in the base top. It could prove rather difficult to threadably secure an entire base onto a bottle. Moreover, the base could become unsanitary rather quickly having liquid spilled within the base and it appears to be rather difficult to clean.

U.S. Pat. No. 6,527,145 issued to Jules G. Bennett, Jr. discloses a personal desktop beverage dispenser that has a base holding an inverted bottle with the bottle male threads threadably secured to the female threads of the dispenser base. An outflow valve controls the flow of bottle contents to a cup placed beneath. While this embodiment can be used with more than one bottle size it requires having to invert the entire base and threadably secure it onto an upright bottle, which could prove to be rather difficult.

U.S. Pat. No. 6,892,903 issued to Salvatore Barolotta discloses a personal beverage bottle dispenser. The personal beverage bottle dispenser requires that the entire base be inverted and threadably secured to the upright bottle in order to union the bottle with the valve.

U.S. Pat. No. 3,104,089 issued to Harold O. Seltsam, shows a self-closing lift type faucet adapted for use with water crocks, certain coolers, and beverage dispensers. Similarly, U.S. Pat. No. 3,207,472 issued Sep. 25, 1965 to Seltsam shows a tubular diaphragm valve. As with the self-closing valve, this valve is again configured for use with water crocks, certain coolers, and beverage dispensers.

U.S. Pat. No. 5,509,583 issued to Chris V. Dolson shows an apparatus for dispensing liquids from a bottle. An inverted supply bottle with a dispenser valve attached is lowered into a slot of a dispenser base. The weight of the bottle rests upon the dispenser valve that is supported at a bottom of the base slot. The weight of the liquid in the bottle may cause the valve to leak. Additionally, the bottle is detached within the dispenser base, as the dispenser base is not formed to fit any particular shape of an inverted bottle.

U.S. Patent Application Publication 20150259188 of Christopher Lawrence Smith shows a vented tap dispenser for a liquid. The Smith embodiment is very much like the Dolson embodiment in that the weight of the inverted supply bottle is supported by the dispenser valve resting upon the dispenser base slot. U.S. Patent Application Publication 20130341355 of Kerry Lloyd Weaver shows a liquid dispensing system for laundry detergent.

SUMMARY OF THE DISCLOSURE

In accordance with one embodiment, a dispenser for delivering a liquid from an inverted supply bottle is disclosed. The dispenser has a base. A top portion of the dispenser base is where the inverted supply bottle is supported. A side opening is formed in a sidewall of the dispenser base. A foot is formed at a bottom portion of the dispenser base. A reservoir container rests upon dispenser base. The reservoir container is detached from the inverted supply bottle. A bottle collar engages a top portion of the dispenser base. The bottle collar is adapted to engage the inverted supply bottle positioned on the bottle collar. The bottle collar has a center aperture in a bottle seat where a mouth of the inverted supply bottle extends through. The liquid from the inverted supply bottle is delivered from the mouth of the inverted supply bottle into the reservoir container and through the side opening in the dispenser base.

In accordance with one embodiment, a dispenser for delivering a liquid from an inverted supply bottle is disclosed. The dispenser has a dispenser base. A top portion of the dispenser base is where the inverted supply bottle is supported. A side opening is formed in a sidewall of the dispenser base. The side opening is surrounded by the sidewall. A foot is formed at a bottom portion of the dispenser base. A reservoir container rests upon dispenser base. The reservoir container is detached from the inverted supply bottle. A bottle collar engages a top portion of the dispenser base. The bottle collar is adapted to engage the inverted supply bottle positioned on the bottle collar. The bottle collar has a center aperture in a bottle seat where a mouth of the inverted supply bottle extends through. The liquid from the inverted supply bottle is delivered from the mouth of the inverted supply bottle into the reservoir container and through the side opening in the dispenser base.

In accordance with one embodiment, a dispenser for delivering a liquid from an inverted supply bottle is disclosed. The dispenser has a dispenser base. A top portion of the dispenser base is where the inverted supply bottle is supported. A side opening is formed in a sidewall of the dispenser base. The side opening is surrounded by the sidewall. A foot is formed at a bottom portion of the dispenser base. A reservoir container rests upon dispenser base. The reservoir container is detached from the inverted supply bottle. A dispenser valve is attached to the reservoir container. The dispenser valve is separate from the sidewall of the dispenser base. A bottle collar engages a top portion of the dispenser base. The bottle collar is adapted to engage the inverted supply bottle positioned on the bottle collar. The bottle collar has a center aperture in a bottle seat where a mouth of the inverted supply bottle extends through. The liquid from the inverted supply bottle is delivered from the mouth of the inverted supply bottle into the reservoir container and through the side opening in the dispenser base.

BRIEF DESCRIPTION OF THE DRAWINGS

In the descriptions that follow, like parts are marked throughout the specification and drawings with the same numerals, respectively. The drawing figures are not necessarily drawn to scale and certain figures may be shown in exaggerated or generalized form in the interest of clarity and conciseness. The disclosure itself, however, as well as a preferred mode of use, further objectives and advantages thereof, will be best understood by reference to the following detailed description of illustrative embodiments when read in conjunction with the accompanying drawings, wherein:

FIG. 5 is a top view of the exemplary water bottle dispenser illustrating a top view of a valve and a valve tube in accordance with one aspect of the present application;

FIG. 6 is a top view of the exemplary water bottle dispenser illustrating a broken view of the valve tube in accordance with one aspect of the present application;

FIG. 13—is a top view of the exemplary alternative water bottle dispenser illustrating a top view of an exemplary valve and an exemplary valve tube in accordance with one aspect of the present application;

FIG. 14—is a top view of the exemplary alternative water bottle dispenser illustrating a broken view of the exemplary valve tube in accordance with one aspect of the present application.

DETAILED DESCRIPTION OF THE DISCLOSURE

Figure 1:
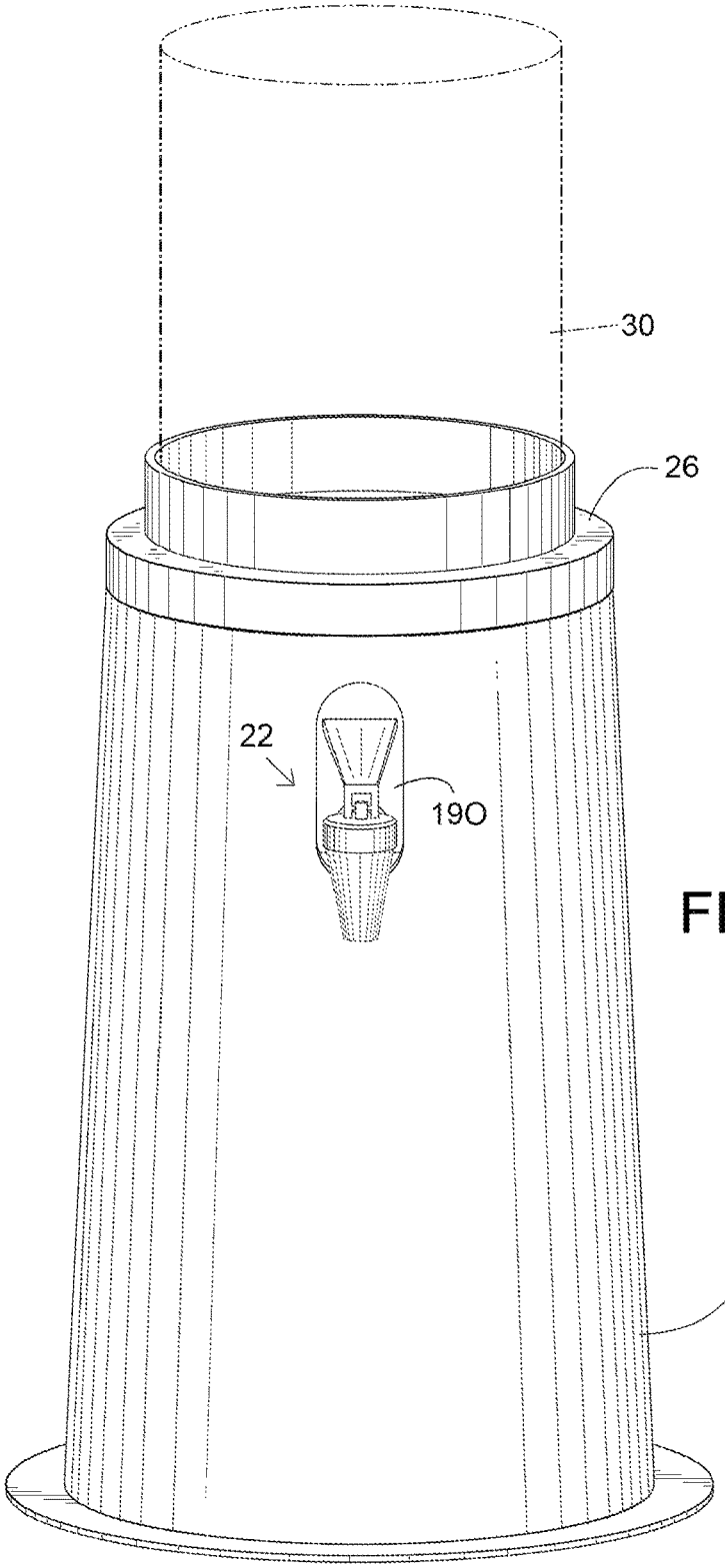
FIG. 1 is a perspective front view of an exemplary water bottle dispenser in accordance with one aspect of the present application.

The description set forth below in connection with the appended drawings is intended as a description of presently preferred embodiments of the disclosure and is not intended to represent the forms in which the present disclosure may be constructed and/or utilized. The description sets forth the functions and the sequence of steps for constructing and operating the disclosure in connection with the illustrated embodiments. It is to be understood, however, that the same or equivalent functions and sequences may be accomplished by different embodiments that also are intended to be encompassed within the spirit and scope of this disclosure.

Accordingly, there are one or more aspects to the present water bottle dispenser that offers advantages over the current existing methods that are being used to serve people water. Embodiments of the disclosure provide a water bottle dispenser that may allow water to be accessed directly from single use water bottles for use with the water bottle dispenser.

In accordance with one embodiment the dispenser may facilitate the cleaning of a reservoir container and a valve of a dispenser. Unlike traditional inverted bottle dispensers, a reservoir container and a dispenser valve of the applicant dispenser may be easily removed from a dispenser base for hand or dishwasher cleaning as the reservoir container may rest upon the dispenser base and the dispenser valve may be separate from the dispenser base. The dispenser base may have a side opening in a sidewall of the dispenser base from which the dispenser valve may easily be removed. Thus the applicant dispenser may eliminate the difficulty of removing and installing a reservoir container and a valve into a dispenser base for the purpose of hand cleaning and/or dishwasher cleaning.

In accordance with one embodiment, the dispenser may have a bottle collar. The bottle collar may be adapted to accommodate various sizes and shapes of inverted bottles. The bottle collar may have a top enclosure that surrounds a sidewall of an inverted bottle. A bottle collar top enclosure may prevent lateral movement of the inverted bottle when engaged with the bottle collar. The bottle collar may have a bottle seat. The bottle seat may be where the inverted bottle engages the bottle collar. The bottle collar may have a center aperture where the mouth if the inverted supply bottle may extend through.

Additionally, the dispenser may be a combination of a unique dispenser base having a side opening in the sidewall of the dispenser base, a reservoir container, and an attached dispenser valve that may be easily removed from the dispenser base when cleaning may be necessary. And lastly, the dispenser may combine the unique dispenser base together with the reservoir container and the dispenser valve and a bottle collar that may be adapted to engage a number of bottles of various shapes and size.

The above advantages of one or more aspects of the water bottle dispenser will become apparent upon reflection of the disclosure set forth below.

Referring to FIG. 1 a perspective front view of an inverted bottle dispenser may be shown. The dispenser may have a dispenser base 19 (hereinafter base 19). In the present embodiment, the base 19 may be cylindrical in shape. However, only one example may be illustrated, and the base 19 may be offered in a number of other geometrical shapes and sizes. The current embodiment may show the base as having a certain height, however, the base could be made to be taller or shorter than the base shown in the current embodiment. As shown in FIG. 1, the base 19 may be tapered. A bottom portion of the base 19 may be wider than an upper portion of the base 19. The tapered nature of the base 19 may provide added stability, and may allow for the base 19 to be stacked. The base 19 may be formed to have a hollow interior. The base 19 may have a removable bottle collar 26 (hereinafter bottle collar 26). The base 19 and the bottle collar 26 may be constructed of a durable plastic such as polypropylene, ABS, or of a metal such as stainless steel. The bottle collar 26 may be removably engaged upon the base 19. The base 19 may be used to support the bottle collar 26 that may be used to house a supply bottle 30 inverted and positioned within the bottle collar 26. A dispenser valve 22 may be viewed extending through a side opening 19O in the base 19. The dispenser valve 22 may be used to dispense water (hereinafter liquid) from the supply bottle 30.

Figure 2:
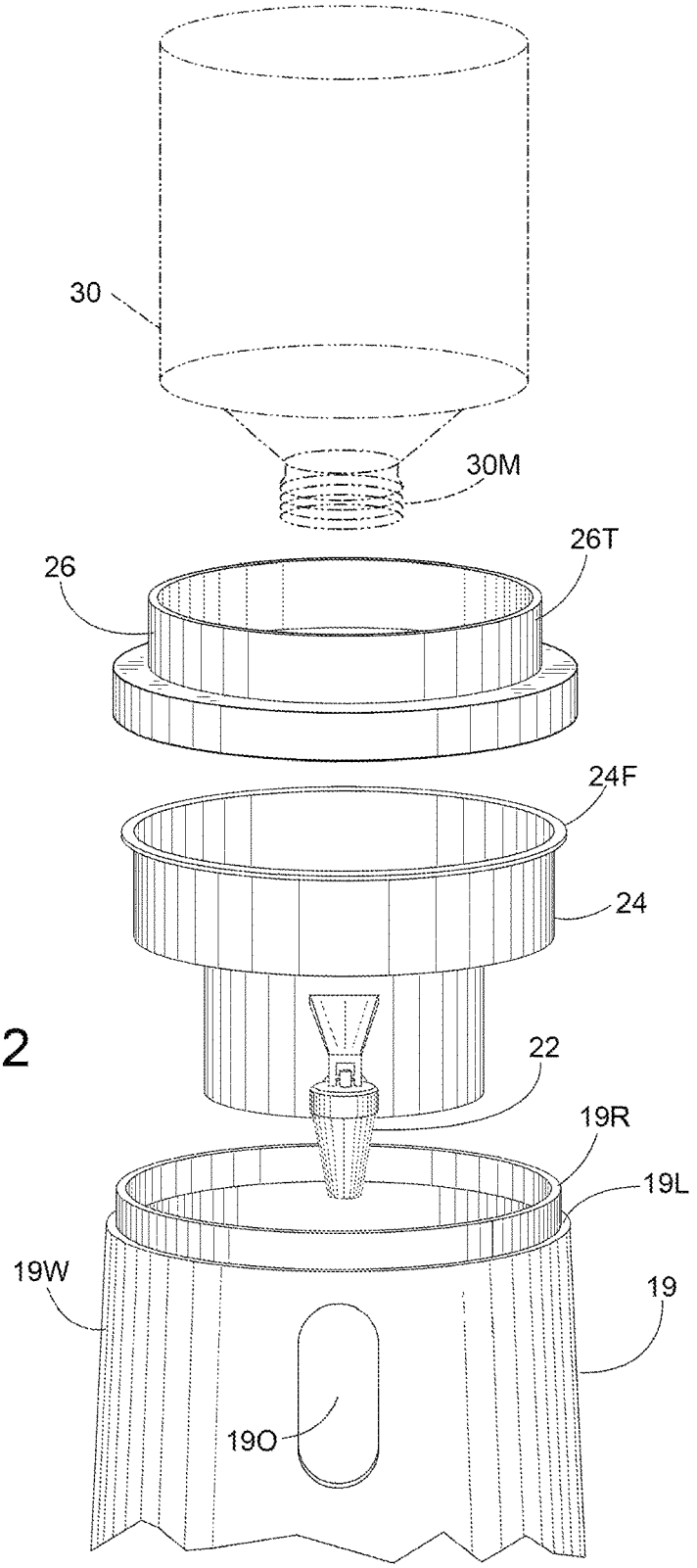
FIG. 2—is an exploded broken view of the exemplary water bottle dispenser of FIG. 1 in accordance with one aspect of the present application.

Referring to FIG. 2, an exploded view of the dispenser of FIG. 1 may be illustrated. A broken view of the dispenser base 19 may be seen at a bottom of FIG. 2. The side opening 19O may be formed in a sidewall 19W of the base 19. The side opening 19O may be surrounded and enclosed by the sidewall 19W of the base 19. A base ledge 19L may be seen located at a top portion of the base 19. A base rim 19R of the base 19 may support a reservoir container 24, and the supply bottle 30 engaged within the bottle collar 26. Moving up, the dispenser valve 22 may be seen attached to the reservoir container 24. In the present embodiment, the reservoir container 24 may be cylindrical in shape. However, only one example may be illustrated, and the reservoir container 24 may be offered in a number of other geometrical shapes and sizes. The reservoir container 24 may be constructed of a food grade plastic material such as polypropylene or high-density polyethylene. A reservoir container flange 24F that may engage the base rim 19R of the base 19 may also be illustrated. The bottle collar 26 may be seen as located above the reservoir container 24. A top enclosure 26T may surround a portion of a sidewall 30S of the supply bottle 30, and may restrict a lateral movement of the supply bottle 30 while engaged within the bottle collar 26. The bottle collar 26 may be seen located above the reservoir container 24. In the present embodiment, the bottle collar 26 may be rounded in shape. However, only one example may be illustrated, and the bottle collar may be offered in a number of other geometrical shapes and sizes to adapt to different sizes and shapes of inverted bottles. The supply bottle 30 that engages the bottle collar 26 may be shown void of a cap (cap not shown) and void of any attachments to a bottle mouth 30M.

Figure 3:
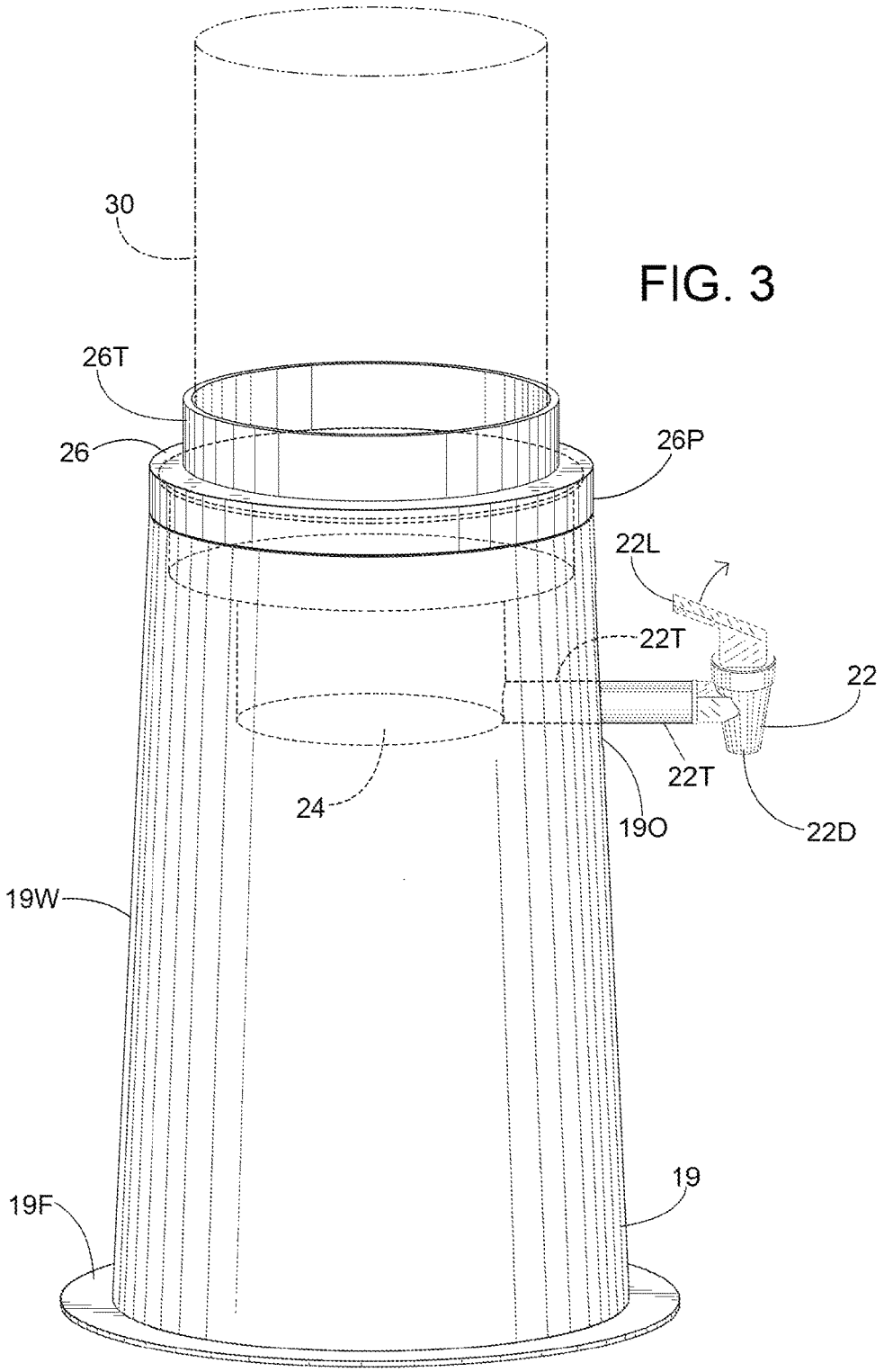
FIG. 3 is a perspective side view of the exemplary water bottle dispenser in accordance with one aspect of the present application.

Referring to FIG. 3 a perspective side view of the inverted bottle dispenser may be shown. A base foot 19F of the base 19 may be seen formed at a bottom portion of the dispenser base. A dispenser tube 22T of the dispenser valve 22 may be seen attached to the reservoir container 24 (reservoir container 24 and dispenser tube 22T shown in dashed lines) and extending through the side opening 19O in a base sidewall 19W of the base 19. A valve activation lever 22L of the valve 22 may be seen. When the valve activation lever 22L of the valve 22 may be forced forward in the direction of the arrow, the liquid from the inverted supply bottle 30 may pass through the reservoir container 24 and may be delivered through the side opening 19O to a location outside the walled dispenser base 19 through a valve discharge opening 22D. The bottle 30 may be seen inserted into the top enclosure 26T, and a peripheral portion 26P of the bottle collar 26 may be seen engaging the base 19.

Figure 4:
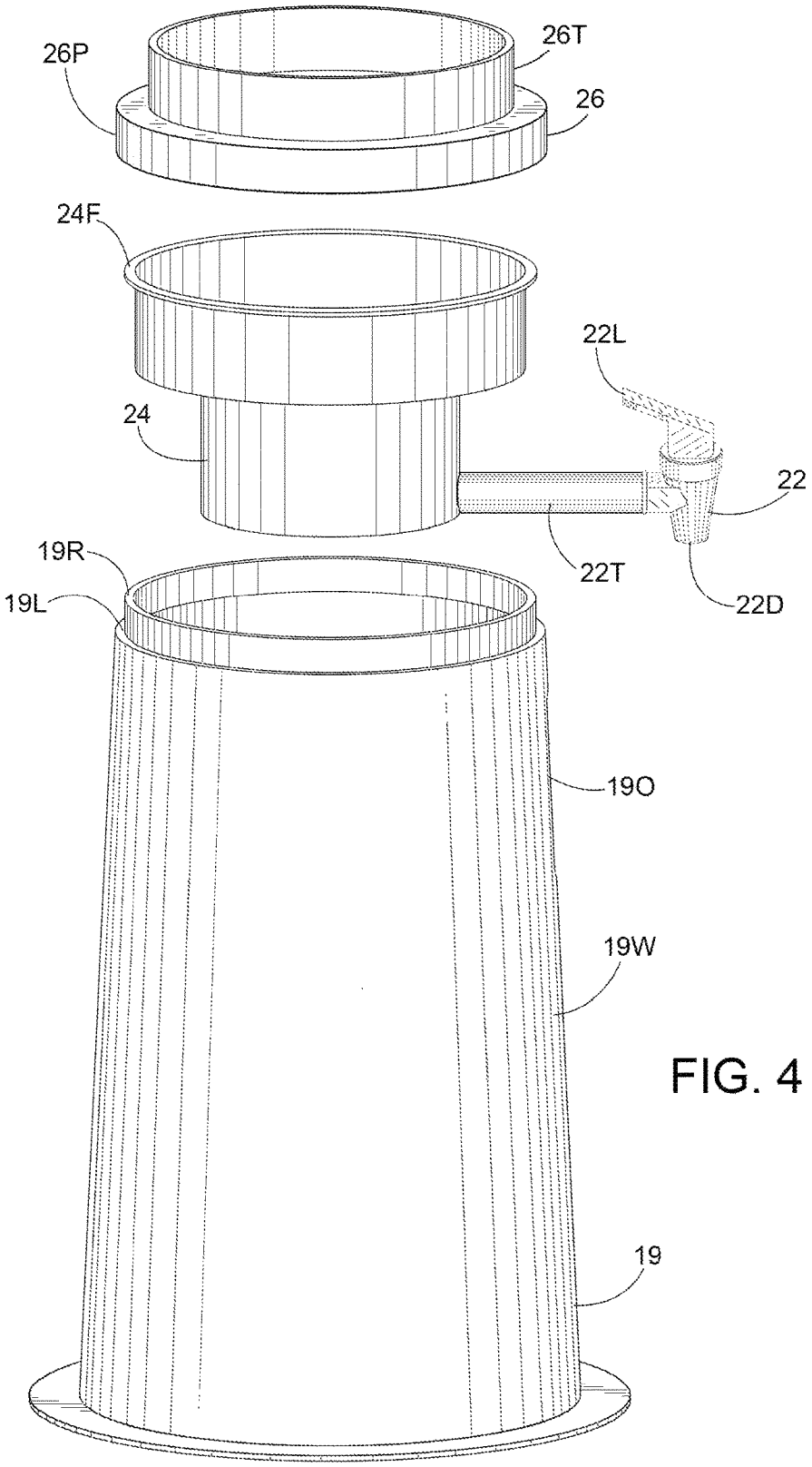
FIG. 4—is an exploded view of the exemplary water bottle dispenser of FIG. 3 in accordance with one aspect of the present application.

Referring to FIG. 4, an exploded view of the dispenser of FIG. 3 may be illustrated. The base 19 may be seen at a bottom of FIG. 4. The side opening 19O may be formed in the sidewall 19W of the base 19. The base ledge 19L, and the base rim 19R may be seen. In the present embodiment the base 19 may be formed having one part, however the base 19 may also be formed of two parts that may be nestable (two part nestable base 19 not shown) in order that the base 19 may be more compact when packaged or stored. Moving up, the valve activation lever 22L and the valve discharge opening 22D, of the dispenser valve 22 may be illustrated. The dispenser valve 22 may be seen attached to the reservoir container 24 with the valve tube 22T. When the dispenser valve 22 may be installed in the dispenser base 19, the dispenser valve 22 may be separate from the base 19. Additionally, in FIG. 4, the dispenser valve 22 may show a direct connection to the reservoir container 24 with the valve tube 22T. However, the dispenser valve 22 could also be attached to the reservoir container 24 using a union, a threaded connection, or other means to connect the dispenser valve 22 to the reservoir container 24. The reservoir flange 24F of the reservoir container 24 may engage and rest upon the base rim 19R of the base 19, thus the reservoir container 24 may be detached from the base 19. The top enclosure 26T of the bottle collar 26, and the peripheral portion 26P of the bottle collar 26 may be seen located above the reservoir container 24.

Referring to FIG. 5, a top view of the dispenser base 19 having the foot 19F may be seen. The top enclosure 26T and a bottle seat 26S, of the bottle collar 26 may be illustrated. The valve tube 22T of the dispenser valve 22 may be viewed extending through the side opening 19O of the dispenser base 19.

Referring to FIG. 6, a top view of the dispenser base 19 may be seen with a broken view of the valve tube 22T extending through the side opening 19O. The top enclosure 26T and the bottle seat 26S, of the bottle collar 26 may be illustrated.

Figure 7:
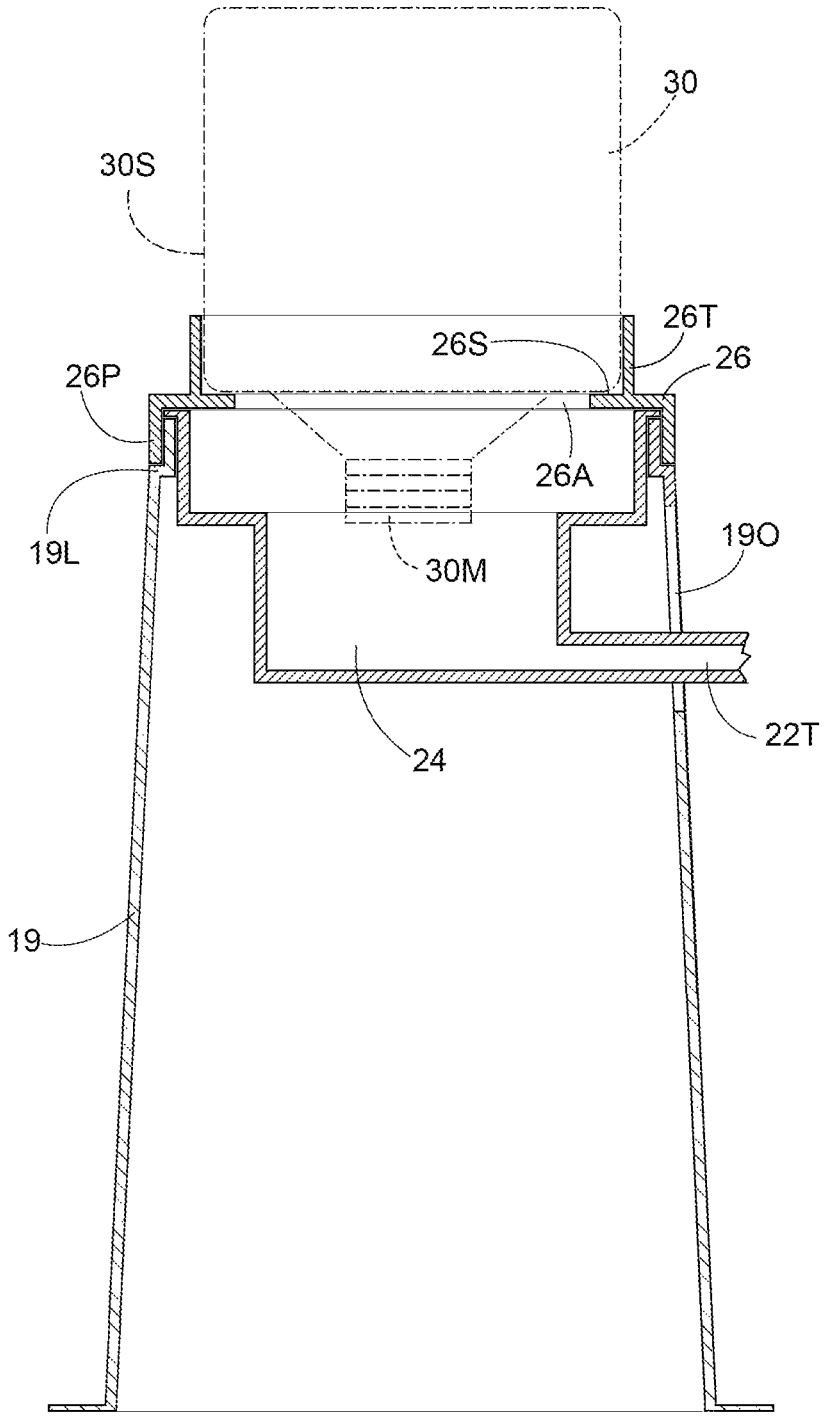
FIG. 7 is a sectional view of FIG. 6 taken at the sectioning plane in the direction indicated by section lines 7-7 in accordance with one aspect of the present application.

Referring to FIG. 7, a sectional view taken at the sectioning plane in the direction indicated by section lines 7-7 of the dispenser base of FIG. 6 may be seen. The bottle 30 may be viewed seated upon the bottle seat 26S, and the sidewall 30S of the bottle 30 may be viewed engaged within the top enclosure 26T of the bottle collar 26. The bottle mouth 30M may be viewed extending through an aperture 26A of the bottle collar 26, and into the reservoir container 24. A broken view of the valve tube 22T that leads to the dispenser valve 22 of FIGS. 3-5 may be illustrated. The peripheral portion 26P of the bottle collar 26 may be seen engaged upon the base ledge 19L located at the top portion of the base 19.

Figure 8:
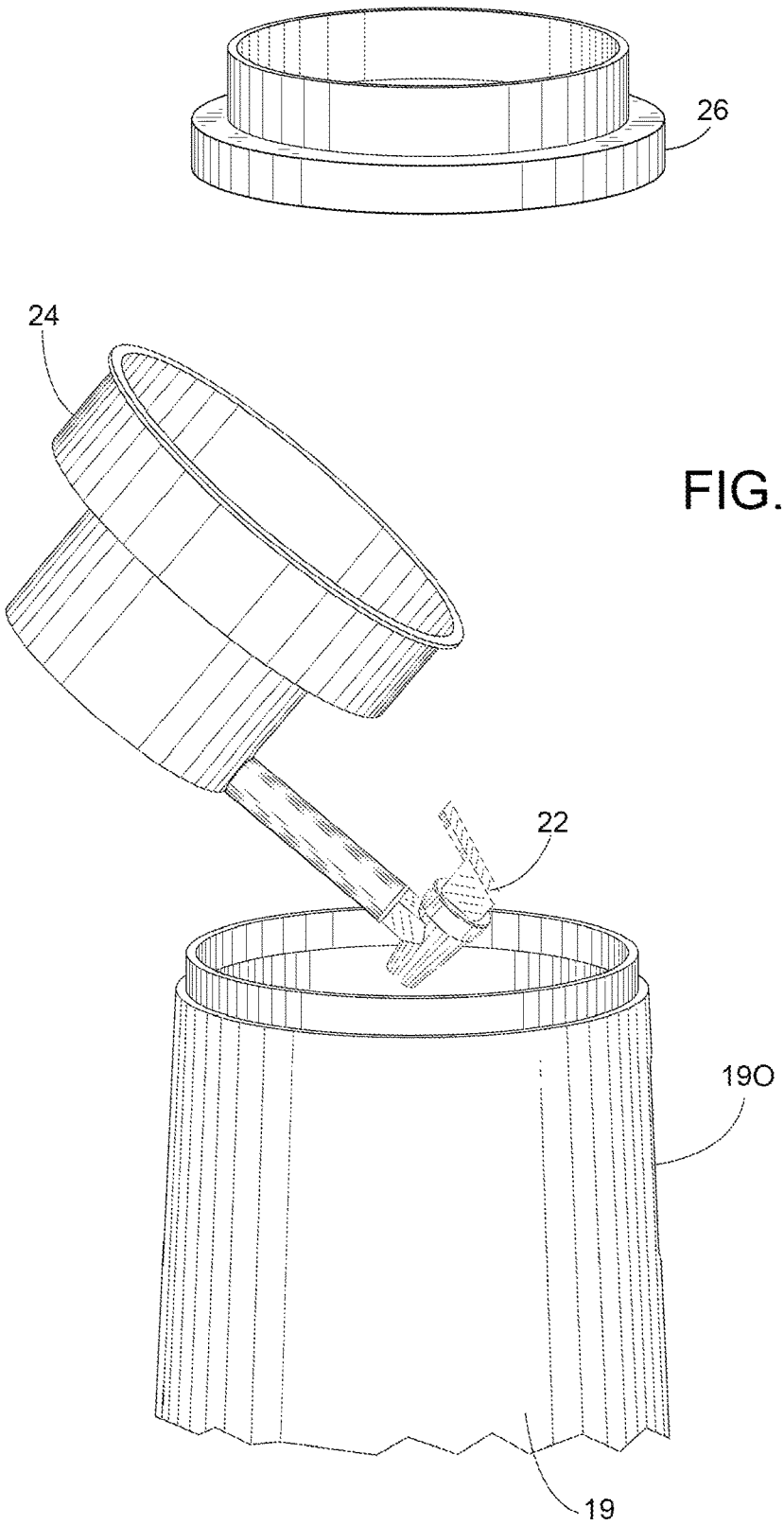
FIG. 8—is an exploded broken view of the exemplary water bottle dispenser of FIG. 3 in accordance with one aspect of the present application.

Referring to FIG. 8, a broken view of the base 19 may be shown. The reservoir container 24 may be installed into the base 19 by angling the reservoir container 24 so that the valve 22 may enter the side opening 19O of the base 19. The bottle collar 26 may then be positioned upon the base 19 as may be seen in FIG. 3.

Figure 9:
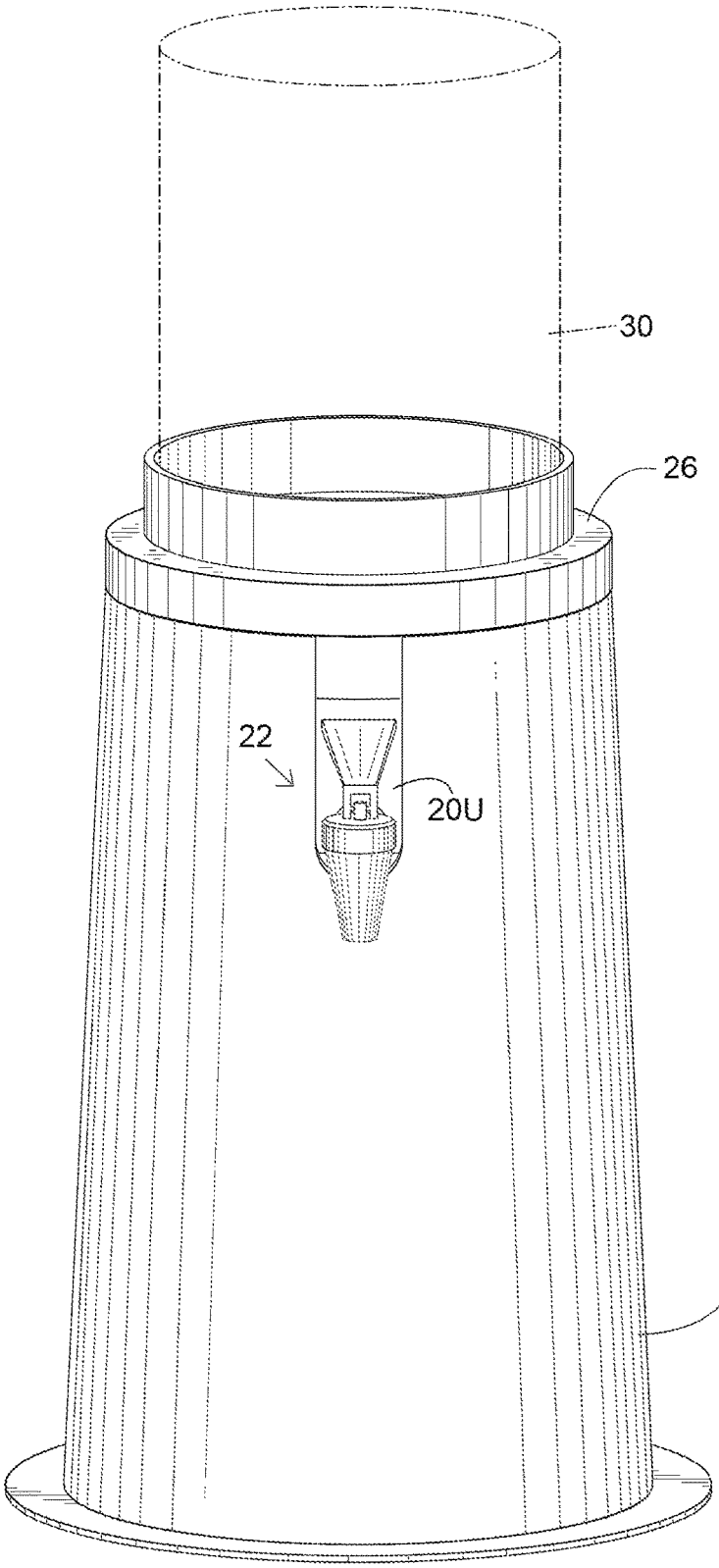
FIG. 9—is a perspective front view of an exemplary alternative water bottle dispenser in accordance with one aspect of the present application.

Referring to FIG. 9, a perspective front view of an alternative inverted water bottle dispenser may be shown. The alternative dispenser may have a dispenser base 20 (hereinafter base 20). In the present embodiment, the base 20 may be cylindrical in shape. However, only one example may be illustrated, and the base 20 may be offered in a number of other geometrical shapes and sizes. The current embodiment may show the base as having a certain height, however, the base could be made to be taller or shorter than the base shown in the current embodiment. As shown in FIG. 9, the base 20 may be tapered. Thus, a bottom portion of the base 20 may be wider than an upper portion of the base 20. The tapered nature of the base 20 may provide added stability, and may allow for the base 20 to be stacked. The base 20 may be formed to have a hollow interior. The base 20 may have the removable bottle collar 26 (hereinafter bottle collar 26). The base 20 and the bottle collar 26 may be constructed of a durable plastic such as polypropylene, ABS, or of a metal such as stainless steel. The bottle collar 26 may be removably engaged upon the base 20. The base 20 may be used to support the bottle collar 26 that may be used to house the supply bottle 30 inverted and positioned within the bottle collar 26. The dispenser valve 22 may be viewed extending through a side opening 20U in the base 20. The dispenser valve 22 may be used to dispense water (hereinafter liquid) from the supply bottle 30.

Figure 10:
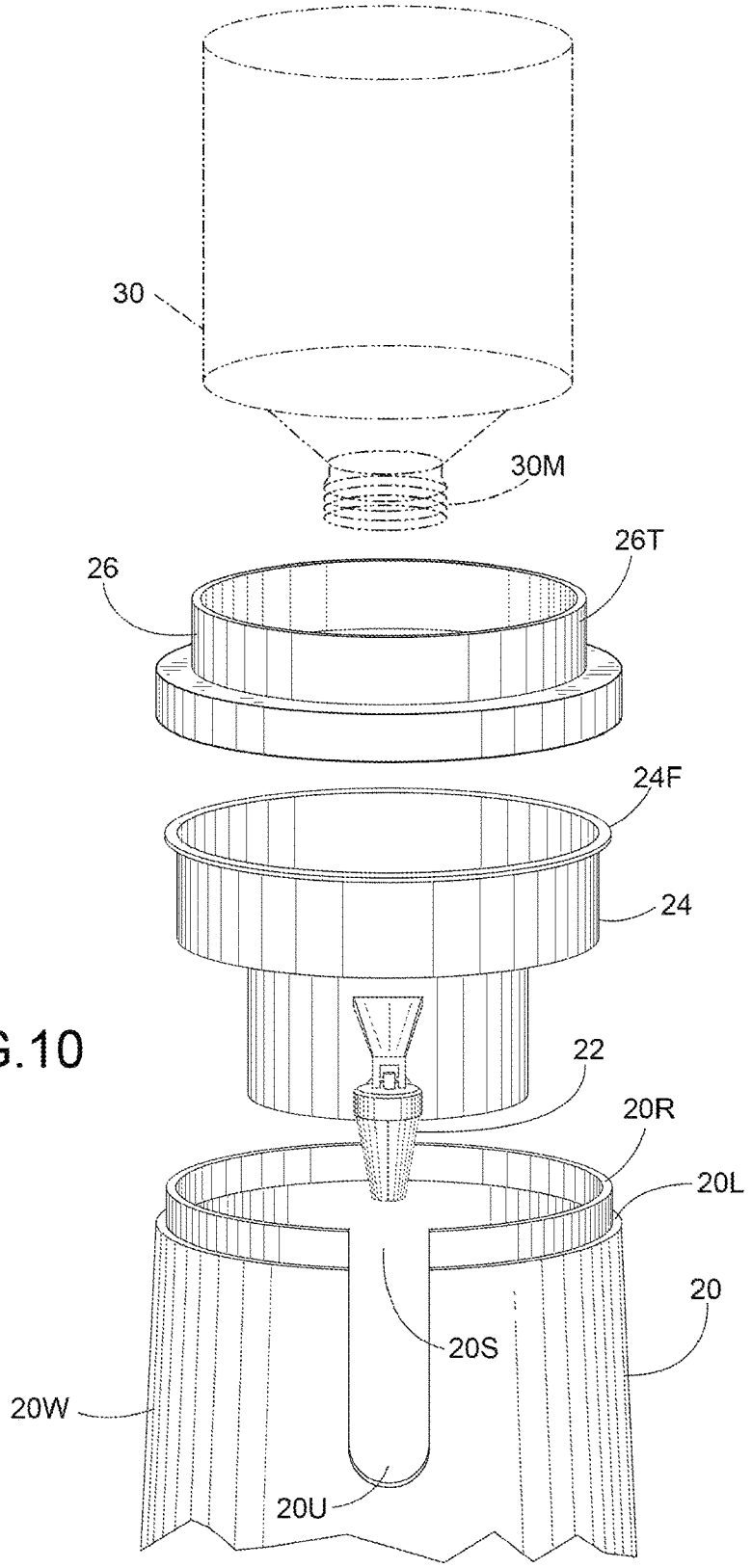
FIG. 10—is an exploded broken view of the exemplary alternative water bottle dispenser of FIG. 9 in accordance with one aspect of the present application.

Referring to FIG. 10, an exploded view of the dispenser of FIG. 9 may be illustrated. A broken view of the dispenser base 20 may be seen at a bottom of FIG. 2. The side opening 20U may be formed in a sidewall 20W of the base 20 and may extend through the open section 20S of the rim 20R. A base ledge 20L, and an open section 20S of a rim 20R may be seen located at a top portion of the base 20. The rim 20R of the base 20 may support the reservoir container 24, and the bottle 30 may engage the bottle collar 26. Moving up, the dispenser valve 22 attached to the reservoir container 24 may be seen. In the present embodiment, the reservoir container 24 may be cylindrical in shape. However, only one example may be illustrated, and the reservoir container 24 may be offered in a number of other geometrical shapes and sizes. The reservoir container 24 may be constructed of a food grade plastic material such as polypropylene or high-density polyethylene. A reservoir container flange 24F that may engage the rim 20R of the base 20 may also be illustrated. The bottle collar 26 may be seen as located above the reservoir container 24. The top enclosure 26T may surround a portion of the sidewall 30S of the supply bottle 30, and may restrict a lateral movement of the supply bottle 30 while engaged within the bottle collar 26. The bottle collar 26 may be seen located above the reservoir container 24. In the present embodiment, the bottle collar 26 may be rounded in shape. However, only one example may be illustrated, and the bottle collar may be offered in a number of other geometrical shapes and sizes to adapt to different sizes and shapes of inverted bottles. The bottle 30 that engages the bottle collar 26 may be shown void of a cap (cap not shown) and may be shown void of attachments to the bottle mouth 30M.

Figure 11:
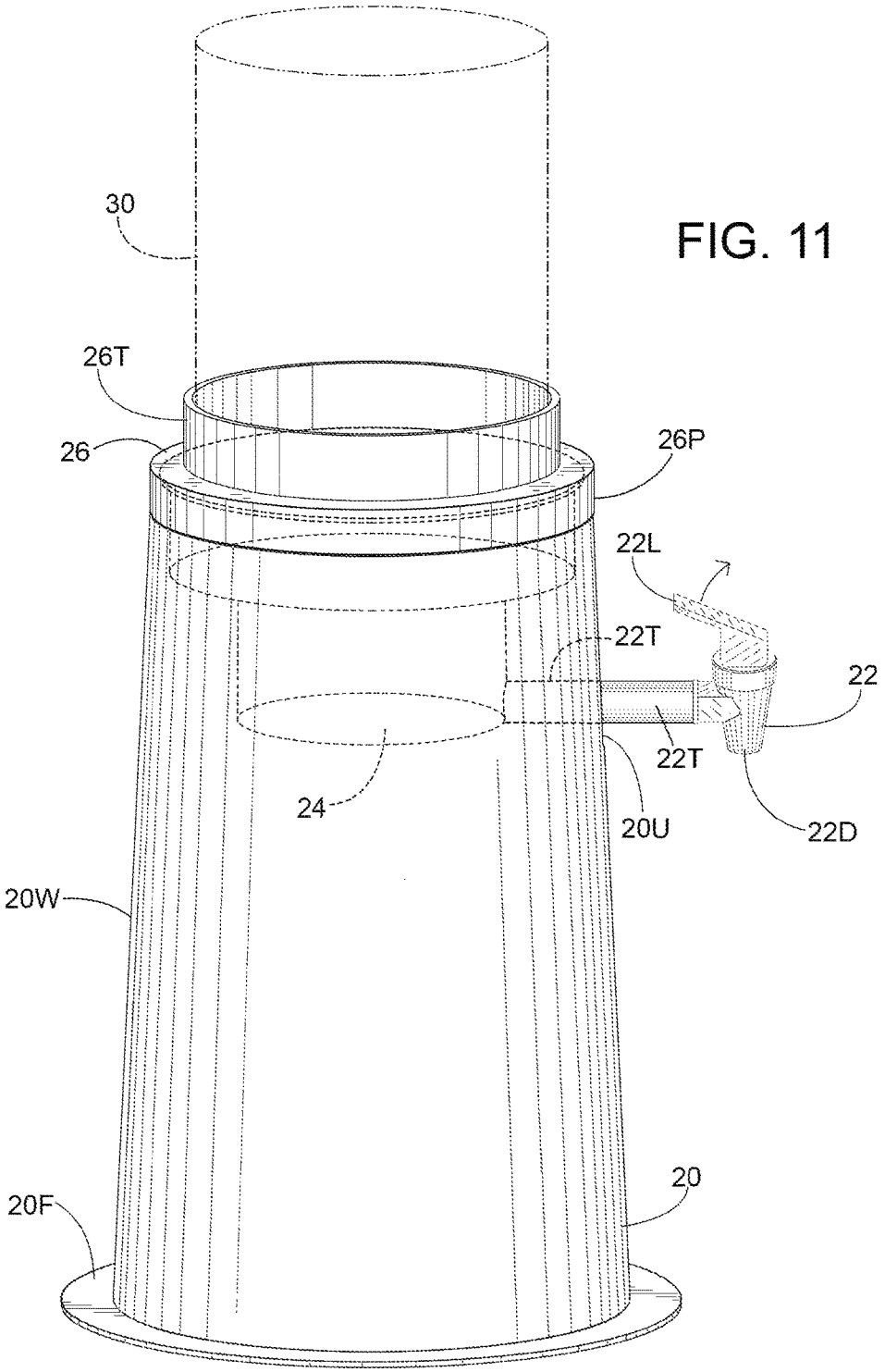
FIG. 11—is a perspective side view of the exemplary alternative water bottle dispenser in accordance with one aspect of the present application.

Referring to FIG. 11 a perspective side view of the alternative inverted bottle dispenser may be shown. A base foot 20F of the base 20 may be seen formed at a bottom portion of the dispenser base. The dispenser tube 22T of the dispenser valve 22 may be seen attached to the reservoir container 24 (reservoir container 24 and dispenser tube 22T shown in dashed lines) and extending through the side opening 20U in a base sidewall 20W of the base 20. A valve activation lever 22L of the valve 22 may be seen. When the valve activation lever 22L of the valve 22 may be forced forward in the direction of the arrow, the liquid from the inverted supply bottle 30 may pass through the reservoir container 24 and may be delivered through the side opening 20U to a location outside the walled dispenser base 20 through the valve discharge opening 22D. The bottle 30 may be seen inserted into the top enclosure 26T, and the peripheral portion 26P of the bottle collar 26 may be seen engaging the base 20.

Figure 12:
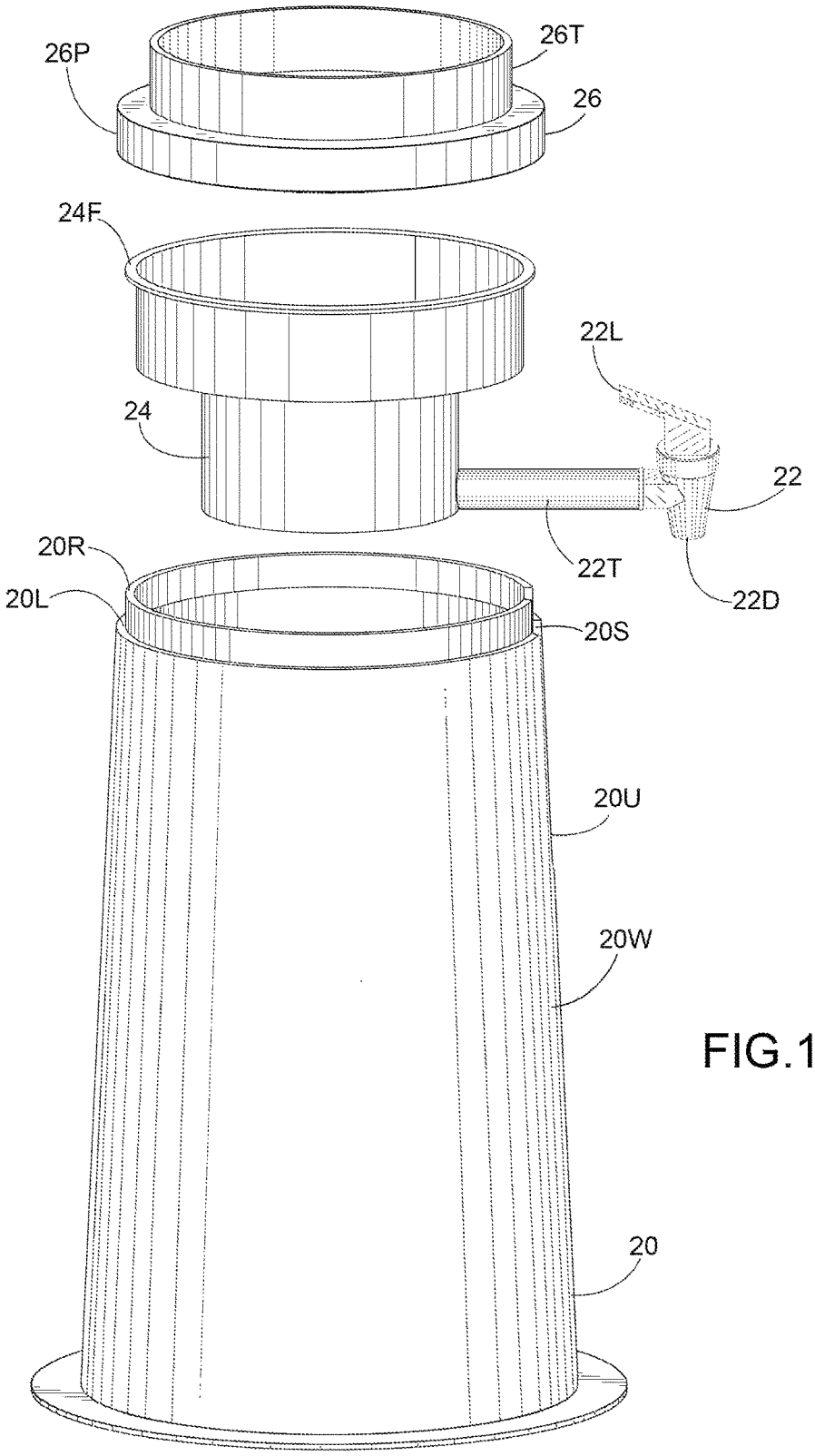
FIG. 12—is an exploded view of the exemplary alternative water bottle dispenser of FIG. 11 in accordance with one aspect of the present application.

Referring to FIG. 12, an exploded view of the alternative dispenser of FIG. 11 may be illustrated. The base 20 may be seen at a bottom of FIG. 12. The side opening 20U may be formed in the sidewall 20W of the base 20. The base ledge 20L, and an open section 20S of the rim 20R may be seen. In the present embodiment the base 20 may be formed having one part, however the base 20 may also be formed of two parts that may be nestable (two part nestable base 20 not shown) in order that the base 20 may be more compact when packaged or stored. Moving up, the valve activation lever 22L and the valve discharge opening 22D, of the dispenser valve 22 may be illustrated. The dispenser valve 22 may be seen attached to the reservoir container 24 with the valve tube 22T. When installed in the dispenser base 20, the dispenser valve 22 may be separate from the base 20. Additionally, in FIG. 12, the dispenser valve 22 may show a direct connection to the reservoir container 24 with the valve tube 22T. However, the dispenser valve 22 could also be attached to the reservoir container 24 using a union, a threaded connection, or other means to connect the dispenser valve 22 to the reservoir container 24. The reservoir flange 24F of the reservoir container 24 may engage and rest upon the rim 20R of the base 20, thus the reservoir container 24 may be detached from the base 20. The top enclosure 26T of the bottle collar 26, and the peripheral portion 26P of the bottle collar 26 may be seen located above the reservoir container 24.

Referring to FIG. 13, a top view of the dispenser base 20 having the foot 20F may be seen. The top enclosure 26T and a bottle seat 26S, of the bottle collar 26 may be illustrated. The valve tube 22T of the dispenser valve 22 may be viewed extending through the side opening 20U of the dispenser base 20.

Referring to FIG. 14, a top view of the dispenser base 20 may be seen with a broken view of the valve tube 22T extending through the side opening 20U. The top enclosure 26T and the bottle seat 26S, of the bottle collar 26 may be illustrated.

Figure 15:
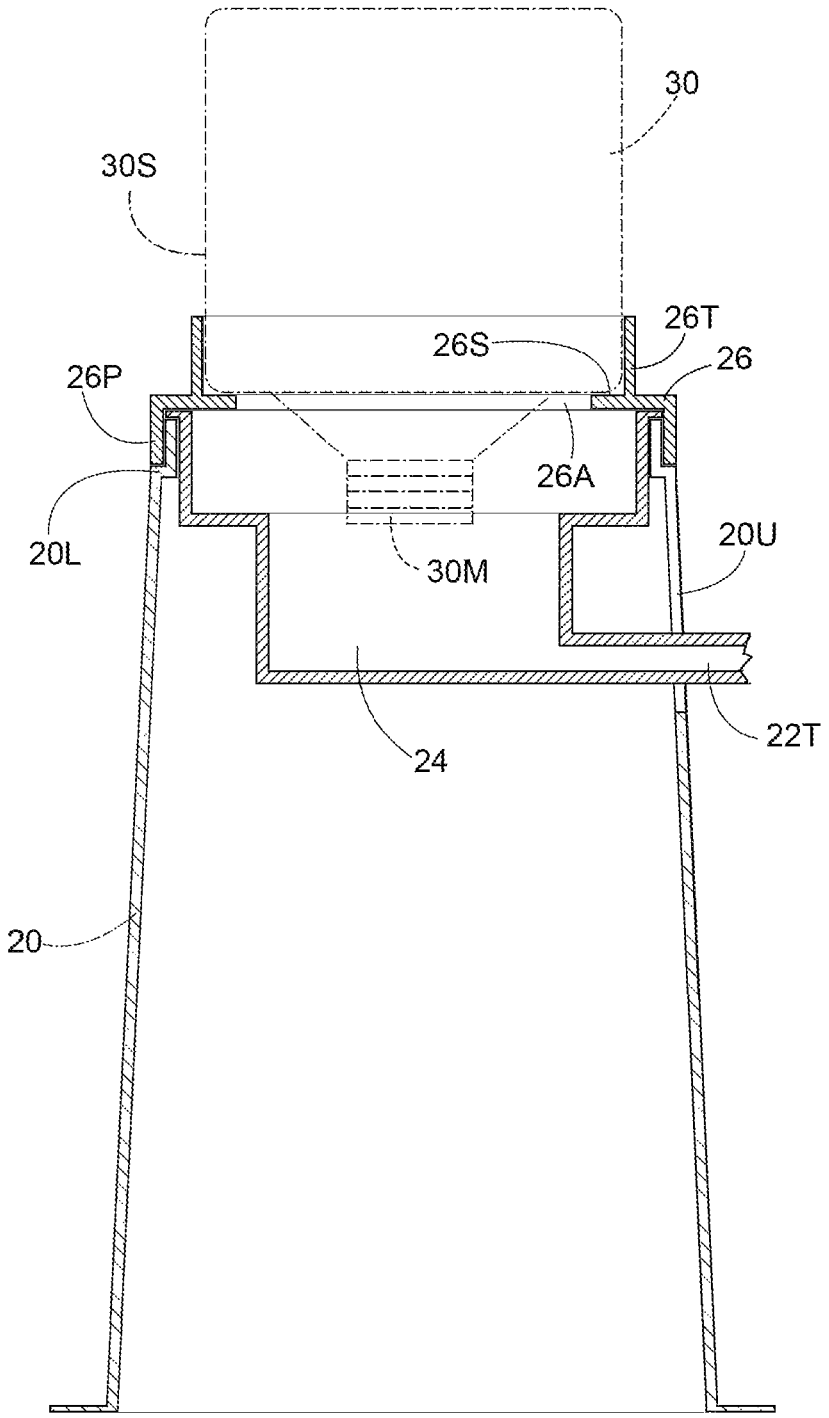
FIG. 15—is a sectional view of FIG. 14 taken at the sectioning plane in the direction indicated by section lines 15-15 in accordance with one aspect of the present application.

Referring to FIG. 15, a sectional view taken at the sectioning plane in the direction indicated by section lines 15-15 of the dispenser base of FIG. 14 may be seen. The bottle 30 may be viewed seated upon the bottle seat 26S, and the sidewall 30S of the bottle 30 may be viewed engaged within the top enclosure 26T of the bottle collar 26. The bottle mouth 30M may be viewed extending through the aperture 26A of the bottle collar 26, and into the reservoir container 24. The broken view of the valve tube 22T that leads to the dispenser valve 22 of FIGS. 3-5 may be illustrated. The peripheral portion 26P of the bottle collar 26 may be seen engaged upon the base ledge 20L located at the top portion of the base 20.

Referring to FIGS. 1-6, and 8 the operation and use of the dispenser may now be described. To begin with, the base 19 of the dispenser of FIG. 4 may be placed upright onto a countertop or desktop. Next, the reservoir container 24 may be lowered at an angle so that the attached dispenser valve 22 may enter through the side opening 19O of the base 19. Next, the reservoir container 24 may be lowered down so that the reservoir flange 24F may rest upon the dispenser base rim 19R. Now the peripheral portion 26P of the bottle collar 26 may be engaged upon the base ledge 19L of the base 19. Lastly, the full supply bottle 30 (FIG. 2) having no cap attached may be quickly inverted so that the liquid from the bottle 30 flows into the reservoir container 24, and the bottle 30 is seated upon the bottle seat 26S within the top enclosure 26T of the bottle collar 26 as seen in FIG. 7. The valve activation lever 22L of the dispenser valve 22 may now be pulled forward in the direction of the arrow as seen in FIG. 3 to dispense the liquid content from the bottle 30.

Referring to FIGS. 9-15, the operation and use of the alternative dispenser may now be described. To begin with, the base 20 of the dispenser of FIG. 12 may be placed upright onto a countertop or desktop. Next, the reservoir container 24 with the attached dispenser valve 22 may be lowered into the base 20 making sure that the valve tube 22T of the dispenser valve 22 is in alignment with the side opening 20U of the base 20, so that the reservoir flange 24F of the reservoir container 24 may rest upon the base rim 20R. Now the peripheral portion 26P of the bottle collar 26 may be engaged upon the base ledge 20L of the base 20. Lastly, the full supply bottle 30 (FIG. 10) having no cap attached may be quickly inverted so that the liquid from the bottle 30 flows into the reservoir container 24, and the bottle 30 is seated upon the bottle seat 26S within the top enclosure 26T of the bottle collar 26 as seen in FIG. 15. The valve activation lever 22L of the dispenser valve 22 may now be pulled forward in the direction of the arrow as seen in FIG. 11 to dispense the liquid content from the bottle 30.

The dispenser of the present invention may provide numerous advantages. The dispenser may accommodate a variety of commercial water bottles that currently have no additional dispensing methods other than the pouring of the water directly from the bottle mouth of the bottle. The dispenser may provide a reservoir container 24. The reservoir container 24 may be attached to a dispenser valve 22. The reservoir container 24 together with the attached dispenser valve 22 may be easily be removed from the dispenser bases 19 and 20 for hand and/or dishwasher cleaning by lifting the reservoir container 24 and removing the dispenser valve 22 from the side openings 19O and 20U respectively. The inverted bottle 30 may be easily installed into bottle collar 26 of the bases 19 and 20 by quickly inverting the bottle 30 so the liquid content of the bottle 30 flows into the reservoir container 24 and the bottle 30 is seated upon the bottle seat 26S within the top enclosure 26T of the bottle collar 26. Additionally, the amount of small water bottle sales may be reduced as the dispenser may allow for more "gallon" or larger jugs to be used in households and may lead to an improvement in the environment as the pollution regarding the smaller water bottles may be reduced in quantity.

While embodiments of the disclosure have been described in terms of various specific embodiments, those skilled in the art will recognize that the embodiments of the disclosure may be practiced with modifications within the spirit and scope of the claims. For example, the base could take on additional geometrical shapes/sizes other than the shape of the dispenser base mentioned in the above description. Moreover, base could be formed in 2 parts that may be nestable in order on make the packaging more compact. Additionally, other embodiments of the reservoir container having different geometrical shapes and sizes may be formed to engage the dispenser base not discussed in the above description. The dispenser valve could be attached to the reservoir container using means other than a direct connection with the valve tube. The bottle collar could take on additional geometrical shapes and sizes to accommodate a variety of differently shaped and sized bottles other than the shapes/sizes mentioned in the above description. Furthermore, the dispenser could be used with inverted beverage bottles in addition to inverted water bottles. Accordingly, the scope should be determined not by the specific embodiments illustrated, but by the appended claims and their legal equivalents.

DRAWINGS—REFERENCE NUMBERS

19—dispenser base
19F—base foot
19L—base ledge
19O—base side opening
19R—base rim
19W—base sidewall
20—alternative dispenser base
20F—base foot
20L—base ledge
20U—base side opening
20R—base rim
20S—base rim open section
20W—base sidewall
22—dispenser valve
22L—valve activation lever
22D—valve discharge opening
22T—valve tube
24—reservoir container
24F—reservoir flange
26—bottle collar
26A—bottle collar center aperture
26P—bottle collar peripheral portion
26S—bottle collar bottle seat
26T—bottle collar top enclosure
30—supply bottle
30M—bottle mouth
30S—bottle sidewall

I claim:

1. A dispenser for delivering a liquid from an inverted supply bottle comprising:

a dispenser base comprising:

a. a top portion whereon the inverted supply bottle is supported;

b. a side opening formed in a sidewall of the dispenser base, c. a foot formed at a bottom portion of the dispenser base;

a reservoir container, the reservoir container resting upon the dispenser base, detached from the inverted supply bottle; and a bottle collar engaging the top portion of dispenser base, the bottle collar adapted to engage the inverted supply bottle positioned thereon, the bottle collar having a center aperture in a bottle seat where a mouth of the inverted supply bottle extends there through, the liquid from the inverted supply bottle being delivered from the mouth of the inverted supply bottle into the reservoir container and through the side opening in the dispenser base.

2. The dispenser for delivering a liquid from an inverted supply bottle of claim 1 comprising a dispenser valve attached to the reservoir container.

3. A dispenser for delivering a liquid from an inverted supply bottle comprising:

A walled dispenser base comprising:

a. a top portion whereon the inverted supply bottle is supported;

b. a side opening formed in a sidewall of the dispenser base, the side opening surrounded by the sidewall;

c. a foot formed at a bottom portion of the dispenser base;

a reservoir container, the reservoir container resting upon the dispenser base, detached from the inverted supply bottle; and a bottle collar engaging the top portion of dispenser base, the bottle collar adapted to engage the inverted supply bottle positioned thereon, the bottle collar having a center aperture in a bottle seat where a mouth of the inverted supply bottle extends there through, the liquid from the inverted supply bottle being delivered from the mouth of the inverted supply bottle into the reservoir container and through the side opening in the dispenser base.

4. The dispenser for delivering a liquid from an inverted supply bottle of claim 3 comprising a dispenser valve attached to the reservoir container.

5. A dispenser for delivering a liquid from an inverted supply bottle comprising:

a dispenser base comprising:

a. a top portion whereon the inverted supply bottle is supported;

b. a side opening formed in a sidewall of the dispenser base;

c. a foot formed at a bottom portion of the dispenser base;

a reservoir container, the reservoir container resting upon the dispenser base, and detached from the inverted supply bottle;

a dispenser valve attached to the reservoir container, the dispenser valve separate from the sidewall of the dispenser base; and a bottle collar engaging the top portion of dispenser base, the bottle collar adapted to engage the inverted supply bottle positioned thereon, the bottle collar having a center aperture in a bottle seat where a mouth of the inverted supply bottle extends there through, the liquid from the inverted supply bottle being delivered from the mouth of the inverted supply bottle into the reservoir container and through the side opening in the dispenser base.

* * * * *